US006979817B2

(12) United States Patent
Yamauchi et al.

(10) Patent No.: US 6,979,817 B2
(45) Date of Patent: Dec. 27, 2005

(54) MICROSPRAY COLUMN, MASS SPECTROMETER, AND MASS SPECTROMETRY

(75) Inventors: Yoshio Yamauchi, Tokyo (JP); Tohru Natsume, Tokyo (JP); Toshiaki Isobe, Tokyo (JP)

(73) Assignee: Nano Solution, Inc., Setagaya-Ken (JP)

( * ) Notice: Subject to any disclaimer, the term of this patent is extended or adjusted under 35 U.S.C. 154(b) by 0 days.

(21) Appl. No.: 10/450,608

(22) PCT Filed: Apr. 8, 2002

(86) PCT No.: PCT/JP02/03477

§ 371 (c)(1),
(2), (4) Date: Jan. 25, 2005

(87) PCT Pub. No.: WO03/043053

PCT Pub. Date: May 22, 2003

(65) Prior Publication Data

US 2005/0121608 A1 Jun. 9, 2005

(30) Foreign Application Priority Data

Nov. 13, 2001 (JP) ..... 2001-347005

(51) Int. Cl.[7] ..... H01J 49/04

(52) U.S. Cl. ..... 250/288; 250/281; 250/282; 216/27; 356/316; 315/111.51

(58) Field of Search ..... 250/288, 281, 250/282; 216/27; 356/316; 315/111.51

(56) References Cited

U.S. PATENT DOCUMENTS

| | | | |
|---|---|---|---|
| 4,990,740 A | 2/1991 | Meyer | |
| 2004/0182818 A1 * | 9/2004 | Moon et al. | 216/27 |

FOREIGN PATENT DOCUMENTS

| | | |
|---|---|---|
| JP | 8-236063 | 9/1996 |
| JP | 11-142372 | 5/1999 |

* cited by examiner

*Primary Examiner*—Nikita Wells
*Assistant Examiner*—Zia R. Hashmi
(74) *Attorney, Agent, or Firm*—Nixon Peabody LLP

(57) ABSTRACT

A problem is to provide a microspray column capable of increasing the ionization efficiency, and a high sensitive mass spectrometer and a mass spectrometric method using such a microspray column. For solving this problem, we provide a column for introducing a sample in an ionization source of a mass spectrometer (ESI/MS) being designed to ionize a sample molecule with electrospray and introduce it into an analyzer, has structural features of: (1) 0.5 μm or less in an inner diameter of a tip opening of the column; (2) 0.5 μm or more and 5 μm or less in a particle size of a column filler; and (3) fritless, a microspray column having the above (1) to (3), a mass spectrometer having such a microspray column in an ionization source, and a mass spectrometric method capable of performing a nonoflow electrospray with the microspray column.

3 Claims, 5 Drawing Sheets

FIGURE 5

HSA(609 a.a.)

T1

1 MKWVTFISLL FLFSSAYSRG VFRR DAHKSE VAHRFKDLGE ENFKALVLIA FAQYLQQCPF
61 EDHVKLVNEV TEFAKTCVAD ESAENCDKSL HTLFGDKLCT VATLRETYGE MADCCAKQEP
121 ERNECFLQHK DDNPNLPRLV RPEVDVMCTA FHDNEETFLK KYLYEIARRH PYFYAPELLF
181 FAKRYKAAFT ECCQAADKAA CLLPKLDELR DEGKASSAKQ RLKCASLQKF GERAFKAWAV
241 ARLSQRFPKA EFAEVSKLVT DLTKVHTECC HGDLLECADD RADLAKYICE NQDSISSKLK
301 ECCEKPLLEK SHCIAEVEND EMPADLPSLA ADFVESKDVC KNYAEAKDVF LGMFLYEYAR
361 RHPDYSVVLL LRLAKTYETT LEKCCAAADP HECYAKVFDE FKPLVEEPQN LIKQNCELFE
421 QLGEYKFQNA LLVRYTKKVP QVSTPTLVEV SRNLGKVGSK CCKHPEAKRM PCAEDYLSVV
481 LNQLCVLHEK TPVSDRVTKC CTESLVNRRP CFSALEVDET YVPKEFNAET FTFHADICTL
541 SEKERQIKKQ TALVELVKHK PKATKEQLKA VMDDFAAFVE KCCKADDKET CFAEEGKKLV
601 AASQAALGL

MICROSPRAY COLUMN, MASS SPECTROMETER, AND MASS SPECTROMETRY

TECHNICAL FIELD

The present invention relates to an improved technique in mass spectrometry. In particular, the present invention relates to an improved technique of a mass spectrometer (ESI/MS) being designed to allow the introduction of a sample molecule with electrospray ionization, and a mass spectrometric method.

BACKGROUND ART

A mass spectrometer (hereinafter, referred to as "MS" (Mass Spectrometer)) is roughly composed of: an "ionization source" for ionizing a sample; an "analyzer" for separating ions according to the ratio of mass/charge, represented by m/ze (wherein m: mass, z: charge number, and e: unit charge); and a "detection and recording part" of ions being separated.

The electrospray ionization technique generally referred to "ESI" (the abbreviation for Electrospray Ionization) is known as one of the methods of ionizing and introducing a sample molecule to an analyzer of MS.

In this electrospray ionization technique, a spray is carried out by applying the high voltage on a sample molecule being brought in ionic state with acid or the like in a solvent.

This electrospray ionization technique is a technique for spraying a sample molecule, which is brought into an ionic state by acid or the like in the solution, by applying high voltage; forming liquid droplets (mist) in micron order, in which many solvent molecules are combined with multi-protonated molecules; and spraying nitrogen to dry and remove the solvent to ionize the sample molecule, followed by subjecting to the above analyzer. As the charge number of ions being generated becomes large in this technique, it may be particularly useful in the measurements of peptide and proteins, respectively.

Here, the electrospray ionization of the sample molecule in the above ionization source of MS is performed by discharging and atomizing (spraying) the sample molecule in small quantities from a column formed of an elongated silica glass generally having an opening with a minute aperture. This column will be referred to as a "microspray column" below.

FIG. 2 is a diagram that simplifies and expresses the configuration of the conventional electrospray ionization technique. The reference numeral 10 denotes a conventional typical microspray column. On the microspray column 10 being formed such that the tip portion thereof has a cusp form, a large number of fillers 10*a* such as chemical bond type silica gels or the like having a particle size of about 50 $\mu$m is formed. In addition, the inner diameter d of the tip portion of the column is about 10 to 15 $\mu$m. Furthermore, the outermost tip portion of the microspray column 10 is loaded with a large-sized bead 10*b* for preventing the discharge of beads, which are also referred to as a flit.

This microspray column 10 is a constituent member of the ionization source of a mass spectrometer 11 and is arranged such that it extends to the front of a pre-column 12 on which a high voltage is loaded. It is configured that fine droplets 14 containing the sample molecule are atomized from the tip portion of the microspray column 10 to the analyzer 13 of the mass spectrometer 11.

However, in the conventional microspray column, the separation efficiency of a chromatograph was insufficient since the particle diameter of the filler in the column was large (generally about 50 $\mu$m).

In addition that the particle size of the filler was large, the inner diameter of the tip opening of the above microspray column was also large. Therefore, the discharge amount of the sample increased and the particle size of charged liquid droplets formed by the spray was also large. As a result, in the process in which the solvent was dried and vaporized, the efficiency of transferring charged electrons to the sample molecule in the solvent was not sufficient. In other words, the ionization efficiency of the sample molecule was insufficient.

Furthermore, the microspray column was configured such that many areas without filling with the filler were formed near the tip opening, resulting in a large discharge amount of the sample and a large particle size of the charged droplet formed with the spray.

Therefore, an object of the present invention is to provide a microspray column capable of improving the ionization efficiency, and a high-sensitive mass spectrometer and a mass spectrometric method using this microspray column.

DISCLOSURE OF THE INVENTION

In order to solve the above-mentioned technical subject, the following means are adopted in this invention.

At first, the microspray column for introducing a sample into an ionization source of a mass spectrometer (ESI/MS) configured to perform an electrospray ionization of the sample molecule and introduce the sample molecule into an analyzer was designed such that (1) the inner diameter of a tip opening of the column is 0.5 $\mu$m or less, (2) a particle size of the filler in the column is larger than 0.5 $\mu$m but not more than 5 $\mu$m, and (3) there is no frit at all (fritless). Here, "frit" means the member of a major-diameter bead and other members for blocking the bead loaded in the tip portion of the column. On the other hand, "fritless" means the configuration in which only the filler is filled in the column without using the frit.

The particle size of the filler is a minimum diameter as much as it cannot be conventionally conceived. In addition, the inner diameter of the tip opening of the microspray column is small. Therefore, the discharge amount of the sample can be substantially made small, compared with the conventional one. For this reason, the particle diameter of the charged droplet formed by the spray can be miniaturized. As a result, it becomes possible to increase the efficiency of transferring the charged electron in the solvent to the sample molecule. Therefore, an increase in ionization efficiency of the sample molecule becomes possible.

It is preferable to shape the tip portion of the microspray column into tapering form as much as possible. In addition, it is preferable to minimize the area of the tip portion of the microspray as much as possible. This is because, when the area of the tip portion of the column is too large, there is a phenomenon in which a large droplet is formed while the solution discharged from the column is being adhered on the tip. Therefore, the liquid droplets can be prevented from becoming fine.

It is preferable that the inner diameter of the tip opening of the column is 0.1 $\mu$m or more. This is because a high pressure is needed for the discharge of a solution when the inner diameter of the tip opening is less than 0.1 $\mu$m.

In the present invention, furthermore, the present invention offers a mass spectrometer characterized by comprising an ionization source constructed such that a sample molecule contained in charged droplets atomized from the above microspray column is ionized, and a mass spectrometric method for performing an nanoflow electrospray using the above microspray column. Here, the term "nanoflow electrospray" means a technique capable of performing a stable electrospray ionization on a solution that contains a sample molecule to be fed at a flow rate in the order of nano liters (nL/min) and introducing into an analyzer of a mass spectrometer.

With this means, it is possible to provide a mass spectrometer having high detection sensitivity and excellent ionization efficiency and a mass spectrometric method.

As described above, the present invention is capable of improving the ionization efficiency of a sample molecule and perfectly performing a nanoflow electrospray by making fine charged liquid particles discharged from the microspray column.

This technique has a technical meaning that the high sensitivity measurement of a high molecular weight compound such as peptide or protein becomes possible because of an increase in the charge number of the ion to be generated.

BRIEF EXPLANATION OF THE DRAWINGS

FIG. 5 is a table of the whole amino acid sequence (609 amino acids) which is the digestive product of trypsin enzyme of human serum albumin.

BEST MODE FOR CARRYING OUT THE INVENTION

Preferable embodiments of the present invention will be described with reference to the attached drawings.

Figure 1:
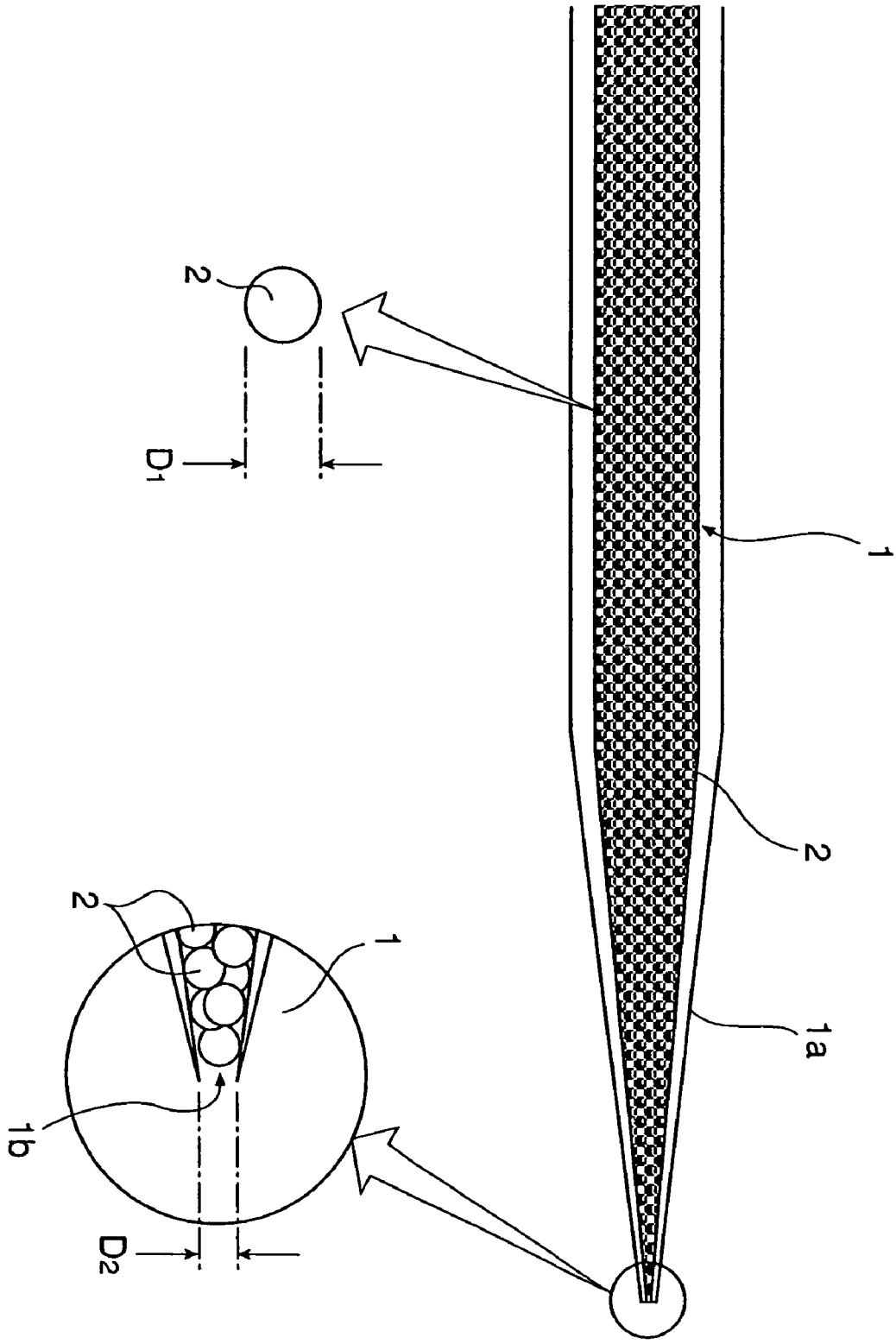
FIG. 1 is a diagram illustrating an extended view around the tip portion of the microspray column of the present invention.
Figure 2:
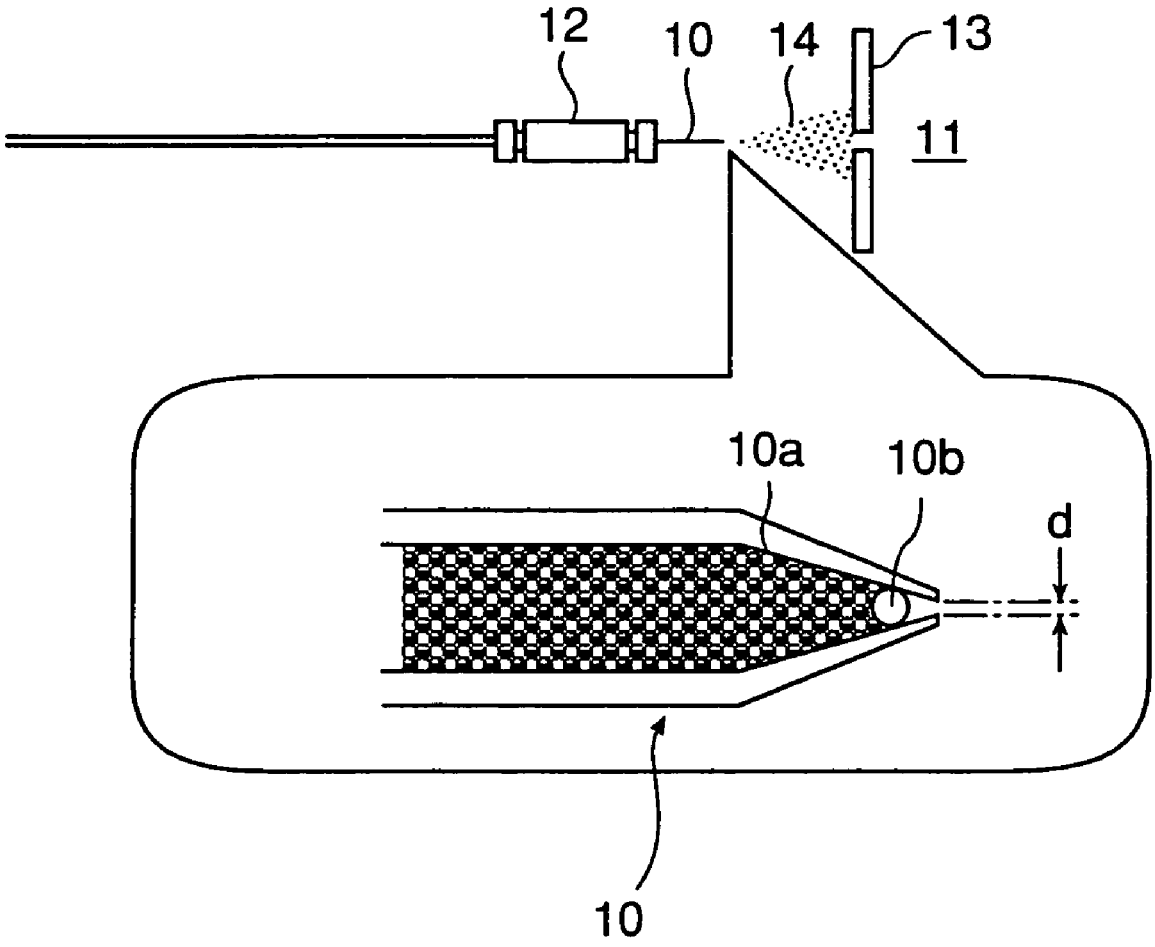
FIG. 2 is a diagram illustrating a simplified configuration of the conventional electrospray column technique.

FIG. 1 is an enlarged view of around the tip portion of the microspray column of the present invention. In FIG. 1, the reference numeral 1 denotes a microspray column (hereinafter, simply referred to as "column") made of silica grass, which is shaped like an elongated cylinder with a hollow formed therein.

This column 1 functions as a sample-installation column which constitutes an ionization source of a mass spectrometer (ESI/MS) designed to introduce a sample molecule into the analyzer after ionizing the sample compound with electrospray. As shown in FIG. 1, the tip portion 1*a* of the column 1 has a cusp form which tapers off gradually, and a tip opening 1*b* having a specific diameter for discharging a sample solution and atomizing the sample solution toward an analyzer of a mass spectrometer not shown in the figure is formed in the outermost tip portion.

Furthermore, in the inside of the column 1, a filler 2 functioned as a sorbent at the time of separating a sample is filled up with uniform density. In the tip opening 1*b*, it is configured such that a frit is not loaded. That is, the column 1 of the present invention is a fritless column.

Here, in the present invention, the inner diameter $D_1$ of the tip opening 1*b* of the column 1 is 0.5 μm or less, preferably 0.1 μm or more and 0.5 μm or less. The particle size $D_2$ of the above filler 2 is more than 0.5 μm and 5 μm or less.

The reason of setting the inner diameter $D_1$ of the tip opening 1*b* to 0.5 μm or less ($D_1 \leqq 0.5$ μm) is that a charged droplet containing a sample molecule separated from the column 1 and atomized from the tip opening 1*b* is sufficiently made smaller to increase the ionization efficiency of the sample molecule with certainty.

Specifically, the inner aperture $D_1$ of tip opening 1*b* is set to 0.5 μm or less to allow the mass spectrometer to generate a large charge number of ions in the sample molecule enough to realize the high-sensitive measurement of a high molecular weight compound such as peptide or protein using a mass spectrometer.

In addition, the reason of defining the particle size $D_2$ of the filler 2 to more than 0.5 μm and 5 μm or less (0.5 μm$<D_2 \leqq 5$ μm) is that for preventing the filer 2 from being discharged through the tip opening 1*b* of 0.5 μm or less in inner diameter. The particle size $D_2$ of the filler is made larger than the inner diameter $D_1$ of the above tip opening 1 ($D_1<D_2$), while the particle size $D_2$ of the filler 2 is made smaller than 5 μm or less to increase the total surface area of the whole filler 2. Furthermore, as the particle size $D_2$ of the filler 2 is defined as 5 μm or less, the results can be obtained within a short time with a small amount of an eluent at a nanoflow level. In addition, a chemical bond type silica gel (e.g., C18 having a large absorbency) may be used as the filler 2.

Figure 3:
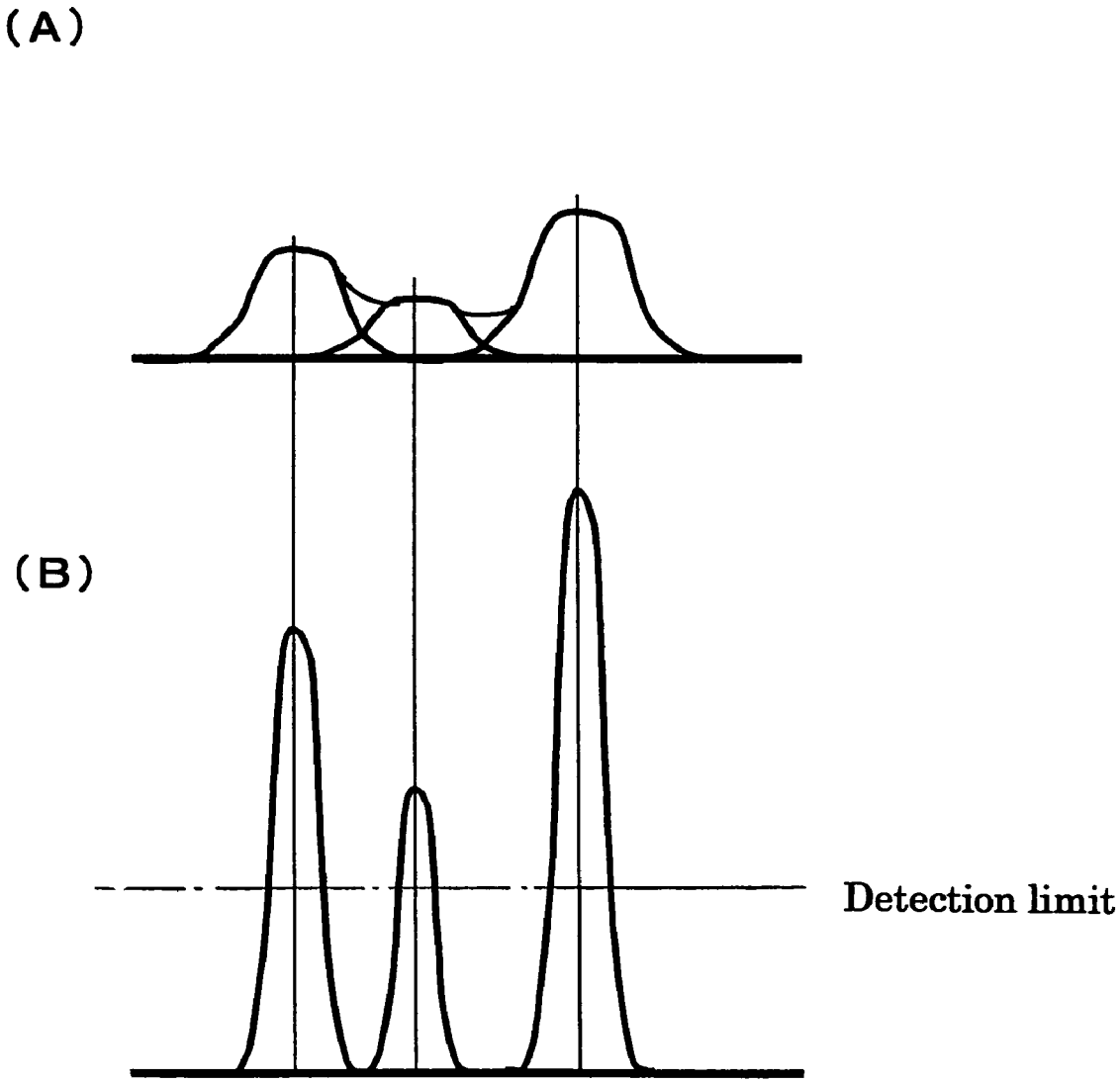
FIG. 3(A) is a schematic diagram of the chromatograph of the mass spectrometer when the conventional microspray column is used.
FIG. 3(B) is a schematic diagram of the chromatograph of the mass spectrometer when the microspray column of the present invention is used.

Here, FIG. 3 is a schematic diagram for making a comparison between the chromatograph (A) of the mass spectrometer at the time of using the conventional microspray column and the chromatograph (B) of the mass spectrometer at the time of using the microspray column of the present invention.

As shown in FIG. 3, the microspray column of the present invention shows a sharp peak in the chromatograph of the mass spectrometer. More concretely, reading of the rising peak and also no tailing in the second half of a peak cannot be , and, more specifically, the tendency of generating a sharp peak that exceeds a detection limit can be notably appeared.

The sensitivity of the mass spectrometer is concentration-dependent, so that the signal strength increases as the peak height increases.

Therefore, using the microspray column of this invention, the sensibility and the resolution of a mass spectrometer become high. In addition, it becomes possible to raise the rate of decoding an amino acid sequence (sequence coverage), exponentially.

EXAMPLE

A solution including a digestive product of a trypsin enzyme derived from human serum albumin (a molecular weight of 65,000 to 70,000) at a concentration of 50 femto mole or less was atomized from a microspray column of the present invention under the conditions in which the tip diameter of the column was 0.5 μm or less, fritless, and the particle size of the filler was 1.0 μm.

Figure 4:
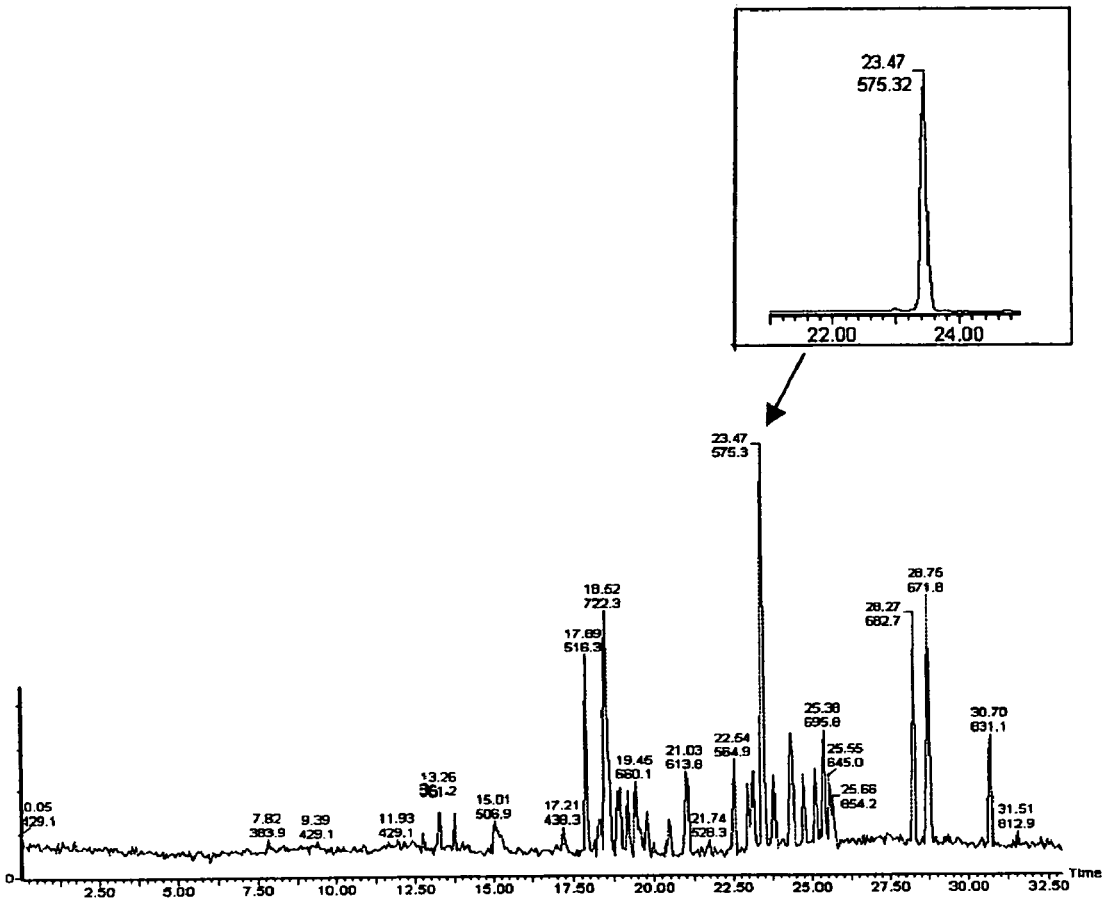
FIG. 4 is a chromatograph of the mass spectrometer obtained in the example.

The chromatograph of the mass spectrometer obtained in the present example is shown in FIG. 4. As shown in the schematic diagram of FIG. 3, the sharp peak without reading or tailing was also obtained by the actual experimental findings as shown in the schematic diagram of FIG. 3, so that the decipherment of an amino acid sequence could be raised exponentially.

FIG. 5 shows a total amino acid sequence table (609 amino acids) of the above digestive product. In this example, the 573 amino acid sequences except of 36 amino-acid portion surrounded by a square enclosure in FIG. 5 were deciphered. The rate of a decipherment was dramatically as high as 94% (573/609).

INDUSTRIAL APPLICABILITY

According to the microspray column of the present invention, the particle size of the filler is a minimum diameter in addition to make the inner diameter of the microspray column equal to a predetermined diameter or less. Therefore, the discharge amount of a sample solution per unit time can be sharply lessened as compared with the conventional one, so that the particle size of charged droplets formed by spraying can be made finer. As a result, the efficiency of transferring the electrons charged in the solvent to the sample molecule can be extensively improved and the ionization efficiency of the sample molecule can be increased. Furthermore, in the present invention, it is characterized by comprising an ionization source designed to ionize the sample molecule to be contained in the charged droplets atomized from the above microspray, so that a mass spectrometer having excellent ionization efficiency and high detection sensitivity can be provided. Furthermore, according to the present invention, a mass spectrometric method that surely performs a nanoflow electrospray and nano-LC gradient analysis by the above microspray column, so that a high sensitive measurement of high molecular weight compound such as peptide and protein can be performed, positively. Consequently, an extensive improvement in the rate of an amino acid decipherment of peptide or protein can be attained.

What is claimed is:

1. A column for introducing a sample in an ionization source of a mass spectrometer (ESI/MS) being designed to ionize a sample molecule with electrospray and introduce it into an analyzer, comprising structural features of:

(1) 0.5 $\mu$m or less in an inner diameter of a tip opening of the column;

(2) 0.5 $\mu$m or more and 5 $\mu$m or less in a particle size of a column filler; and (3) fritless.

2. A mass spectrometer, comprising:

an ionization source which is constructed such that a sample molecule in liquid droplets atomized from the microspray column described in claim 1 is ionized.

3. A mass spectrometric method, wherein a nonoflow electrospray is performed using the microspray column described in claim 1.

* * * * *